United States Patent [19]

Lea et al.

[11] 4,283,487

[45] Aug. 11, 1981

[54] THERMOLABILE ACUTANCE DYES FOR DRY SILVER

[75] Inventors: Bernard A. Lea; Ronald W. Burrows, both of Harlow, England

[73] Assignee: Minnesota Mining and Manufacturing Company, St. Paul, Minn.

[21] Appl. No.: 98,386

[22] Filed: Nov. 29, 1979

[51] Int. Cl.[3] ..... G03C 1/84; G03C 1/02

[52] U.S. Cl. ..... 430/522; 430/517; 430/619

[58] Field of Search ..... 430/513, 517, 522, 346, 430/619, 594, 570, 353

[56] References Cited

U.S. PATENT DOCUMENTS

| | | | |
|---|---|---|---|
| 2,411,507 | 11/1946 | Collins et al. | 430/576 |
| 3,988,156 | 10/1976 | Sturmer | 430/522 |
| 4,088,497 | 5/1978 | Brown et al. | 430/353 |

*Primary Examiner*—Richard L. Schilling

*Attorney, Agent, or Firm*—Cruzan Alexander; Donald M. Sell; Mark A. Litman

[57] ABSTRACT

Images produced in photothermographic emulsions using silver halide as a light-sensitive material therein suffer from light scattering effects on the silver halide.

Acutance dyes, many of which are novel, are disclosed which can absorb scattered light and which are bleached at the development temperature of the photothermographic composition.

15 Claims, No Drawings

THERMOLABILE ACUTANCE DYES FOR DRY SILVER

This invention relates to compounds suitable for use as acutance dyes in photosensitive compositions, to the preparation of such compounds and to photosensitive compositions containing the compounds. The invention is particularly concerned with photosensitive compositions of the type known as "dry silver" compositions.

BACKGROUND TO THE INVENTION

Dry silver photosensitive compositions comprise an intimate mixture of a light sensitive silver halide and another silver compound such as a silver salt of an organic acid, e.g. silver behanate or silver saccharine, which upon reduction gives a visible change and which is substantially light-insensitive. Such a mixture is usually prepared in suspension and the resulting dispersion spread as a layer on a suitable substrate. When dry, the layer is exposed to a light image and thereafter a reproduction of the image can be developed by heating the layer in the presence of a reducing agent such as hydroquinone or certain substituted phenols.

It is because the exposure and development of the layer occur without using water, that these materials are often referred to as dry silver light-sensitive materials. Such materials in which minor amounts of a photosensitive silver halide catalyst-progenitor are associated in catalytic proximity with major amounts of a heat sensitive oxidation-reduction image forming reaction mixture which reacts more rapidly in the presence of the catalyst resulting upon exposure of the silver halide are well known in the art. Examples of such materials are described in our British Pat. No. 1,110,046 and in U.S. Pat. Nos. 3,839,049 and 3,457,075.

We believe, that when the mixture is exposed to light, a latent image is formed in the silver halide. Thereafter, the silver compound can be reduced by heating with the reducing agent, this reduction being catalysed imagewise by the light exposed silver halide. By a suitable choice of temperature, the reduction of the silver compound can be catalysed in the light exposed areas to give a visible darkening while any slight reduction which occurs in the non-light exposed areas is insufficient to give a marked change. Of course, because the silver halide acts as a catalyst progenitor, only very small amounts of it can suffice, e.g. 0.1 to 10% by weight of the mixture. However, large amounts, e.g. up to 15 or even 20% may be desirable in some circumstances.

In order to improve the sharpness or definition of photographic images a dye known as an acutance dye is often incorporated into photosensitive compositions. To be effective the acutance dye will absorb at the wavelengths at which the photosensitive composition is sensitive. The longer the path length of the light in the layer of light sensitive composition the greater the attenuation. Therefore, scattered light is attenuated or absorbed to a larger extent that light which impinges directly on a light-sensitive crystal. As a result therefore, although the overall speed of the composition is reduced slightly, scattered light and other light rays which are liable to produce a blurred image are preferentially absorbed and so the overall definition and sharpness of images produced in the layer are increased.

An acutance dye for use in a dry silver composition is preferably heat labile, that is to say, it is destroyed by the heat development of the dry silver composition to one or more compounds which are substantially colourless.

It is therefore an object of this invention to provide dry silver compositions containing acutance dyes, which absorb light at at least some of those wavelengths to which the composition is sensitive and which are rendered colourless upon heat development of the dry silver composition.

It is also an object of the invention to provide novel compounds suitable for use as acutance dyes in dry silver systems and a method for their preparation.

SUMMARY OF THE INVENTION

According to the invention there is provided a light sensitive composition comprising an intimate mixture of a substantially light-insensitive silver compound which upon reduction gives a visible change and amount sufficient of a silver halide to catalyse said reduction to give a visible change in those areas where the silver halide has been exposed to light when the intimate mixture is heated in the presence of a reducing agent, the intimate mixture including as an acutance dye a compound of the general formula:

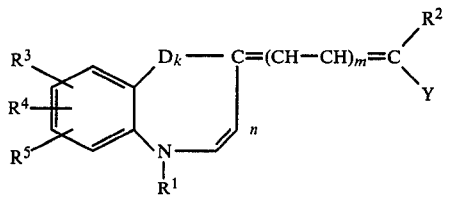

(I)

wherein:

n is 1 when k is 0 or k is 1 when n is 0, m is 0, 1 or 2,

Y is a member selected from the group consisting of —CN and $NO_2$, $R^1$ represents an alkyl group consisting of 1 to 12 carbon atoms, generally 1 to 8 carbon atoms, preferably 1 to 4 carbon atoms, more preferably methyl or ethyl, $R^2$ is a member selected from the group consisting of a phenyl group, a substituted phenyl group of molecular weight less than 350, —$COOR^1$ wherein $R^1$ is an alkyl group of 1 to 12 carbon atoms, $C_6H_5CO$— or $R^6HN.CO$— wherein $R^6$ is a member of the group consisting of a hydrogen atom, alkyl, aryl or aralkyl group, and when m is 1 or 2 $R^2$ may additionally represent a member of the group consisting of a hydrogen atom and an alkyl group having 1 to 4 carbon atoms, $R^3$, $R^4$ and $R^5$ are cyanine dye compatible substituents, D represents a number of the group consisting of —CH=CH—, O, S, Se, $>C(CH_3)_2$ or $>NR^7$ wherein $R^7$ is selected from the group consisting of an alkyl group containing 1 to 4 carbon atoms and $CH_3COO$— with the proviso that:

when k=0, n=1, m=0 and Y is $NO_2$ $R^2$ is not a substituted phenyl group of the formula:

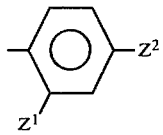

wherein one of $Z^1$ and $Z^2$ is $NO_2$ and the other is a member of the group consisting of a halogen atom, $—NO_2$ —CN and a perfluoroalkyl group containing 1 to 4 carbon atoms.

The substituents $R^3$, $R^4$ and $R^5$ independently represent a substituent which, as known in the art, can be present in a cyanine dye type heterocylic nucleus, defined herein as a "cyanine dye compatible substituent", referring to the broadly art accepted knowledge of substituents. A range of such substituents are disclosed for example in U.S. Pat. No. 2,921,067.

Examples of substituents for $R^3$, $R^4$ and $R^5$ include hydrogen or halogen, e.g. chlorine, bromine or iodine, an alkyl group containing 1 to 12 carbon atoms, an alkoxy group containing 1 to 4 carbon atoms, an alkenyl group containing 2 to 4 carbon atoms, $—(CH_2)_nCOOH$ where n is 0, 1, 2 or 3, $—NO_2$, $—NH_2$ or $—NHCOCH_3$, or any two of $R^3$ to $R^5$ together represent the carbon atoms needed to complete a fused on benzene ring. Preferably at least one, more preferably at least two, of the substituents $R^3$ to $R^5$ represent hydrogen atoms. The most preferred substituents to be represented by each of $R^3$ to $R^5$ are hydrogen, chlorine or bromine atoms, or methyl, ethyl, methoxy or ethoxy groups.

It is found that dry silver compositions containing one of the above described compounds as an acutance dye can give excellent sharp images and that the actuance dye will be rendered considerably lighter in colour or substantially colourless by the heating required to develop the composition. This is surprising in view of the fact that many of these dyes are found not to be decomposed to a colourless state when they are heated on their own to the temperature at which the dry silver compositions are heated for development.

The exact mechanism for this decomposition is not known although the extent of decolourisation has been found to vary when the dry silver systems are altered. Thus a dye may be decomposed to a colourless state when it is present in one particular dry silver system upon development but in a different system the dye may simply be rendered lighter in colour. Thus a compound for use as an acutance dye in a particular dry silver system is selected not only for its efficiency as an acutance dye in that system but also to obtain the desired background after the dry silver composition is developed.

One preferred group of acutance dyes for use in the invention are those in which k=0, n=1, Y is $NO_2$ and $R^2$ is $COOC_2H_5$, $C_6H_5$, $C_1$ to $C_4$ alkyl or hydrogen.

A second preferred group of acutance dyes for use in the invention are those in which m=1, k=1, n=0, Y is $NO_2$, D is oxygen or sulphur and $R^2$ is $COOR^1$, $C_6H_5$, substituted phenyl, $C_1$ to $C_4$ alkyl or hydrogen.

These two groups of dyes have been found to yield substantially colourless products upon development of the dry silver system.

The acutance dyes can be incorporated into the dry silver compositions of the invention in an amount from $5\times10^{-4}$ to 0.1 mole of acutance dye per kilogram of total dry solids in the composition. Preferably, however the dyes are incorporated in an amount of from $2\times10^{-3}$ to $3\times10^{-2}$ mole of acutance dye per kilogram of dry solids in the composition.

The light-sensitive compositions of the invention will normally be spread for use on a support, suitable supports including, for example, paper, polyester or polyamide film bases, and glass. The composition will normally be prepared as a solution or suspension which is spread as a layer on the support and then the solvent or vehicle is evaporated off to leave a dry photosensitive layer. If desired, a coating aid or binder such as polyvinyl butyral, polymethyl methacrylate, cellulose acetate, polyvinyl acetate, cellulose acetate-propionate and cellulose acetate butyrate, can be incorporated in the light-sensitive mixture.

The substantially light-insensitive silver compound is suitably a silver salt of an organic acid. The organic acid can be a $C_{12}$ to $C_{29}$ aliphatic acid and is preferably a $C_{16}$ to $C_{25}$ aliphatic acid. Examples include silver behenate, silver caprate, silver laurate, silver myristate, silver palmitate, silver stearate, silver arachidate and silver saccharine.

The reducing agent for this substantially light-insensitive silver compound can normally be quite mild. Suitable examples include hydroquinone and substituted phenols such as 1-methyl-4-hydroxynaphthalene, methyl gallate, catechol, phenylene diamine, p-aminophenol and 1-phenyl-3-pyrazolidone. The reducing agent can be incorporated into the light-sensitive composition. Alternatively, the composition can be placed in contact with the reducing agent after exposure to light. For example, a light-sensitive coating can be exposed to a light image, placed in contact with a layer containing the reducing agent and the image then developed by heating. Preferably, however, the reducing agent is incorporated in the light-sensitive composition before this is spread on the support. Then the storage stability of the composition can be improved by incorporating in the composition a small amount of a stabilizer such as an acid stabilizer, e.g. succinic acid, benzoic acid or salicylic acid.

The silver halide can be present in amounts of up to 20% by weight of the mixture of silver compounds or can be present in small amounts, e.g. 0.1 to 10% by weight of the mixture of silver compounds. It can be added as such to the substantially light-insensitive compound or formed in situ by adding a soluble halide, e.g. a mercury or sodium halide, to the substantially light-insensitive silver compound. The silver halide can, for example, be chloride, bromide or a mixture of them and/or other silver halides.

The light-sensitive compositions of the invention can include one or more sensitising dyes to improve their sensitivity to parts of the spectrum other than the shorter wavelengths. Thus dye sensitized dry silver compositions of the present invention can contain an additional acutance dye such as one of those described in our copending British Patent Application No. 1 6677/77.

Certain of the compounds suitable for use as acutance dyes in the present invention are known. Certain compounds of the above formula in which m=0 are disclosed in J.A.C.S. 74,2110, C.A. 55 27373 g and U.S. Pat. No. 2,411,507 and other compounds in which m=1 are described by Severin & Bohme in Chem. Ber. 101 2925. There is no indication in any of the prior art that such compounds would be suitable for use as acutance dyes in silver halide photothermographic emulsions.

Many of the compounds for use as acutance dyes in accordance with the invention are novel and therefore according to one embodiment of the invention there is provided a compound of the general formula:

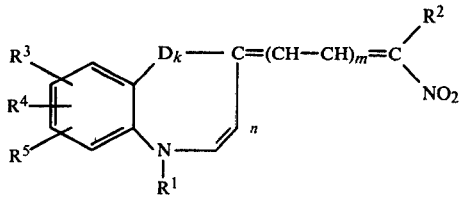

wherein:

$R^1$ represents an alkyl group containing 1 to 12 carbon atoms, $R^3$, $R^4$ and $R^5$ are cyanine dye compatible substituents, D represents a member of the group consisting of CH=CH—, O, S, Se, $>C(CH_3)_2$ or $>NR^7$ in which $R^7$ is selected from an alkyl group containing 1 to 4 carbon atoms or $CH_3COO$— n is 1 when k is 0 or k is 1 when n is 0, m is 0, 1 or 2, when m is 0 or 2:

$R^2$ represents a member selected from the group consisting of an alkyl group, a phenyl group, a substituted phenyl group of molecular weight less than 350, —$COOR^1$ wherein $R^1$ is as defined above, $C_6H_5CO$— or $R^6NH.CO$— wherein $R^6$ is a member of the group consisting of a hydrogen atom or an alkyl, aryl or aralkyl group, and when m is 1:

$R^2$ represents $R^6NH.CO$— wherein $R^6$ is as defined above.

The invention also provides a general method for preparing compounds of the type described. Therefore according to a further embodiment of the invention there is provided a method of preparing a compound of the general formula:

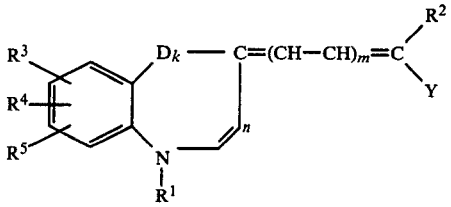

wherein:

n is 1 when k is 0 or k is 1 when n is 0, m is 0, 1 or 2,

Y is a member selected from the group consisting of —CN and $NO_2$, $R^1$ represents an alkyl group containing 1 to 12 carbon atoms, $R^2$ is a member selected from the group consisting of a phenyl group, a substituted phenyl group of molecular weight less than 350, —$COOR^1$ wherein $R^1$ is an alkyl group of 1 to 12 carbon atoms, $C_6H_5CO$— or $R^6NH.CO$— wherein $R^6$ is a member of the group consisting of a hydrogen atom, alkyl, aryl or aralkyl group and when m is 1 or 2 $R^2$ may additionally represent a member of the group consisting of a hydrogen atom and an alkyl group having 1 to 4 carbon atoms, $R^3$, $R^4$ and $R^5$ are cyanine dye compatible substituents, D represents a member of the group consisting of CH=CH, O, S, Se, $>C(CH_3)_2$ or $>NR^7$ wherein $R^7$ is selected from the group consisting of an alkyl group containing 1 to 4 carbon atoms and $CH_3COO$—, which comprises reacting a compound of the general formula:

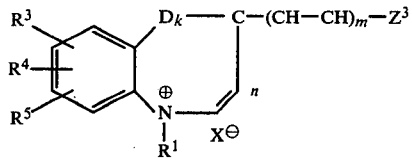

wherein:

$X^\ominus$ represents an anion, $Z^3$ is selected from the group consisting of $SR^1$, wherein $R^1$ is as defined above, and

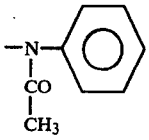

with a compound of the formula:

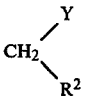

wherein Y and $R^2$ are as defined above, the reaction being conducted in the presence of a polar solvent, a base catalyst and an acid binding agent.

Suitable reagents are well known and fully exemplified in the cyanine/merocyanine dye literature.

The reaction is preferably carried out in the presence of $C_2H_5OH$ as a solvent and $(C_2H_5)_3N$ as both catalyst and acid binder. The preparation is analogous to known processes used in the synthesis of merocyanine dyes.

The invention will now be illustrated by the following Examples.

EXAMPLE 1

Preparation of 4-(cyano-4'-nitrophenylmethylene)-1-methylquinolane (Compound No. 14)

1-Methyl-4-methylthio-quinolinium toluene-4-sulphonate (1.83 g) was placed in ethanol (20 ml) and 4-nitrophenylacetonitrile (0.81 g) added. The mixture was warmed, triethylamine (0.8 ml) added and the resulting mixture heated under reflux for 15 minutes. The dye which separated from the hot solution was filtered off and the crude compound (1.2 g) was twice crystalised from toluene (200 ml) to give magenta needles (0.9 g) having a melting point of 203° to 204° C. In methanolic solution the dye exhibited $\epsilon=2.0\times10^4$ at λmax 495 nm.

EXAMPLE 2

Preparation of
4(ethoxycarbonyl-nitromethylene)-1-methyl-quinolane
(Compound No. 12)

1-Methyl-4-methylthio-quinolinium toluene-4-sulphonate (1.8 g) and ethyl nitroacetate (1 ml) were placed in ethanol (10 ml) and the mixture warmed. After the addition of triethylamine (0.7 ml) the whole was heated under reflux for 10 minutes. The product crystallised upon cooling and was filtered off. The crude product was purified by boiling with ethanol (70 ml), to give both an undissolved residue (0.8 g) and a crystallised sample (0.25 g) Both samples formed yellow plates with melting point of 203° to 206° C. and the recrystallised sample showed $\epsilon=6\times10^3$ in methanolic solution at λmax 465 nm.

Analysis: Calculated: N 10.0%. Found: N 10.2%.

EXAMPLE 3

Preparation of
3-ethyl-2(3-nitro-3-phenyl-allylidene)-2,3-dihydrobenzothiazole (Compound No. 21)

2-Acetanilinoninyl-3-ethyl-benzothiazolium iodide (4.5 g) was placed in ethanol (25 ml) and phenyl nitromethane (1.4 g) added. The mixture was warmed, triethylamine (1.4 ml) added and the resulting mixture heated under reflux for 20 minutes. Upon cooling, a mixture of product and trimethincyanine dye was deposited. This was filtered off and the product extracted with toluene. The extracted solid was then crystallised from ethanol (350 ml) to give dark green coloured plates (2.4 g) having a melting point of 155° C. In methanolic solution the dye exhibited $\epsilon=6.2\times10^4$ at λmax 523 nm.

Analysis: Calculated: N 8.64%; S 9.87%. Found: N 8.69%; S 9.85%.

EXAMPLE 4

Preparation of
3-ethyl-2-(3-ethoxycarbonyl-3-nitro-allylidene)-2,3-dihydrobenzoxazole (Compound No. 20)

2-Acetanilino-3-ethyl-benzoxazolium iodide (2.17 g) was placed in ethanol (10 ml) and ethyl nitroacetate (1.0 ml) added. The mixture was warmed, triethylamine (0.7 ml) added and the resulting mixture heated under reflux for 7 minutes. The dye separated upon cooling and after filtration the crude product (1.2 g) was crystallised from toluene (17 ml) to give yellow needles (1.05 g) having a melting point of 172° to 175° C. In methanolic solution the dye exhibited $\epsilon=5.6\times10^4$ at λmax 452 nm.

Analysis: Calculated: C 59.21%; H 5.26%; N 9.21%. Found: C 58.90%; H 5.59%; N 9.10%.

EXAMPLE 5

Preparation of
3-ethyl-2-(5-ethoxycarbonyl-5-nitro-penta 2,4-dienylidene)-2,3-dihydrobenzothiazole (Compound No. 34)

2-(4'-Acetanilino-1,3-butadienyl)-3-ethyl benzothiazolium iodide (4.76 g), ethyl nitroacetate (1.2 ml), ethanol (100 ml) and triethylamine were mixed and stirred at room temperature for 15 hours. The whole was then evaporated and the residue extracted with six portions (50 ml) each of toluene at 50° C. The residue obtained by evaporation of the toluene was crystallised from aqueous methanol to give dark microcrystals (0.5 g) with a melting point of 125° C. In methanolic solution the compound showed $\epsilon=4.6\times10^4$ at λmax 574 nm.

Analysis: Calculated: C 59.0%; H 5.20%; N 8.1%. Found: C 59.5%; H 5.4%; N 8.1%.

EXAMPLE 6

Evaluation of acutance dyes

A dry silver composition was first prepared. Under room light a 1000 g dispersion containing 12.5 parts of silver behenate in 87.5 parts of solvent which in turn comprised 75 parts butan-2-one and 25 parts toluene was charged to a mixing vessel maintained at 15° C. 20 g of polyvinyl butyral resin (Butvar, B-76) and 10 g of 1-methyl-2-pyrrolidinone were added and the mixture stirred for 30 minutes.

Under Wratten 1A safelight a mixture containing hydrobromic acid (15 ml, 2.0 molar in ethanol), hydroiodic acid (7 ml, 0.1 molar in ethanol), and mercuric bromide (4 ml, 0.5 molar in ethanol) was added with stirring. After 20 minutes an additional 40 g of Butvar B-76 was added, followed after five minutes by 10 g 2,6-bis-(2'-hydroxy-3'-tertiary-butyl-5'-methyl-benzyl)-4-methylphenol available from American Cyanamide under the name A080 and 6 g phthalazinone. After 20 minutes 12 g of a solution containing 2 mg of the following dye:

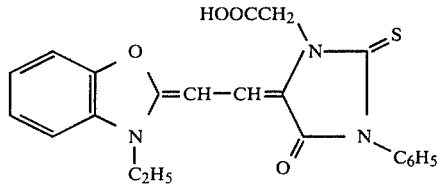

per gram of 1-methyl-2-pyrrolidinone was added and the mixture stirred for an additional 30 minutes.

Equimolar amounts of the acutance dyes to be tested were added to appropriate containers and dispersed in 2 ml of butane-2-one. 40 g portions of the light sensitive dispersion prepared above were added to each, the mixture shaken, left to stand 30 minutes, then shaken again prior to coating.

Knife coatings 100 microns thick on polyester sheets were prepared from each sample and dried 3.5 to 4.0 minutes at 90° C. These dried coatings were overcoated with a solution containing 97 parts butan-2-one and 3 parts vinyl chloride vinyl acetate copolymer available from Union Carbide under the name VYNS with the knife set 50 microns above the base and dried as before. The performance of these compositions was then evaluated.

A combination of a tungsten source, a narrow band filter at a wavelength closely matching the spectral absorbance of each dye and an aperture target overlaid with a 0 to 4 continuous density wedge in a vacuum frame, was used to make contact exposures at a wavelength closely matching the spectral absorbance maximum of each dye. The strips were then processed by heating for 20 seconds in a fluorochemical bath and examined for flare of the image.

The acutance property of the dyes was classified very good, good, fair by examining the sharpness of the image with the naked eye.

The background before and after processing was observed.

The following Table reports compounds of the general formula (I).

The mode of preparation of the compounds is indicated in the final column, in which:

1. refers to a preparation disclosed in Chem. Ber. 101 2295,
2. refers to a preparation analogous to Example 2,
3. refers to a preparation analogous to Example 3,
4. refers to a preparation analogous to Example 5.

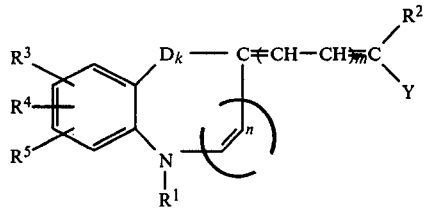

| Cmpd. No. | $R^1$ | $R^2$ | $R^3,R^4,R^5$ ($R^3$ in the 6-position) | m | k,n | D | Y | λ max (MeOH) nm | M.P. °C. | Acutance | Background before processing | Background after processing | Prep. |
|---|---|---|---|---|---|---|---|---|---|---|---|---|---|
| 1 | $CH_3$ | $COOC_2H_5$ | H, H, H | 0 | 1,0 | —CH=CH— | CN | 410 | 183–4 | good | p.yellow | lighter | 2 |
| 2 | $C_2H_5$ | $COOC_2H_5$ | $CH_3O$,H,H | 0 | 1,0 | —CH=CH— | CN | 435 | 123–5 | good | p.yellow | lighter | 2 |
| 3 | $CH_3$ | $COOC_2H_5$ | H, H, H | 0 | 0,1 | — | CN | 433 | 183 | v. good | p.yellow | lighter | 2 |
| 4 | $CH_3$ | $C_6H_5$ | H, H, H | 0 | 0,1 | — | $NO_2$ | 510 | | fair | red | v. pale | 2 |
| 5 | $CH_3$ | $C_6H_5$ | H, H, H | 0 | 1,0 | S | $NO_2$ | 409 | 188 | good | p.yellow | lighter | 2 |
| 6 | $CH_3$ | $C_6H_5$ | H, H, H | 0 | 1,0 | —CH=CH— | $NO_2$ | 490 | 215–7 d | fair | pink | lighter | 2 |
| 7 | $CH_3$ | $—C_6H_4NO_2$ | H, H, H | 0 | 1,0 | S | $NO_2$ | 406 | 265 d | v. good | p.yellow | lighter | 2 |
| 8 | $CH_3$ | $—C_6H_4NO_2$ | H, H, H | 0 | 1,0 | —CH=CH— | $NO_2$ | 404(480) | 217 | v. good | pink | lighter | 2 |
| 9 | $CH_3$ | $C_6H_5CO$— | H, H, H | 0 | 1,0 | S | $NO_2$ | 392 | 220 | good | yellow | lighter | 2 |
| 10 | $CH_3$ | $C_6H_5CO$— | H, H, H | 0 | 0,1 | — | $NO_2$ | 466 | 170 | good | yellow | v. pale | 2 |
| 11 | $CH_3$ | $—C_6H_4NO_2$ | H, H, H | 0 | 0,1 | — | $NO_2$ | 410(500) | 212–3d | | | | 2 |
| 12 | $CH_3$ | $COOC_2H_5$ | H, H, H | 0 | 0,1 | — | $NO_2$ | 465 | d203–6 | | | | Ex. 2 |
| 13 | $CH_3$ | $C_6H_5NHCO$ | $CH_3$, H, H | 0 | 0,1 | — | $NO_2$ | 467 | | | | | 2 |
| 14 | $CH_3$ | $C_6H_4NO_2$ | H, H, H | 0 | 0,1 | — | CN | 495 | | | | | Ex. 1 |
| 15 | $C_2H_5$ | $C_6H_4NO_2$ | H, H, H | 1 | 1,0 | S | CN | 520 | 260–1d | good | magenta | pale | 3 |
| 16 | $C_2H_5$ | $C_6H_4NO_2$ | H, H, H | 1 | 1,0 | O | CN | 488 | 228–30d | good | red | pale | 3 |
| 17 | $C_2H_5$ | $C_6H_4NO_2$ | H, H, H | 1 | 1,0 | —CH=CH— | CN | 540 (570) | 275d | good | violet | pale | 3 |
| 18 | $C_2H_5$ | $C_6H_5NO_2$ | H, H, H | 1 | 0,1 | — | CN | 620 (583) | 245d | good | blue | v. pale | 3 |
| 19 | $C_2H_5$ | $COOC_2H_5$ | H, H, H | 1 | 1,0 | S | $NO_2$ | 483 | 178–180 | good | orange | pale | 3 |
| 20 | $C_2H_5$ | $COOC_2H_5$ | H, H, H | 1 | 1,0 | O | $NO_2$ | 452 | 172–5 | good | yellow | pale | Ex.4 |
| 21 | $C_2H_5$ | $C_6H_5$ | H, H, H | 1 | 1,0 | S | $NO_2$ | 523 | 155 | good | magenta | colour-less | Ex.3 |
| 22 | $C_2H_5$ | $C_6H_5$ | H, H, H | 1 | 1,0 | O | $NO_2$ | 487 | 188 | good | orange | colour-less | 3 |
| 23 | $C_2H_5$ | $C_6H_5$ | H, H, H | 1 | 1,0 | —CH=CH— | $NO_2$ | 554 | 135–140 | good | magenta | pale | 3 |
| 24 | $C_2H_5$ | $C_6H_5$ | H, H, H | 1 | 0,1 | — | $NO_2$ | 602 | 157 | v. good | blue | colour-less | 1 |
| 25 | $CH_3$ | $C_6H_5$ | H, H, H | 1 | 0,1 | — | $NO_2$ | 602 | 195 | v. good | blue | colour-less | 1 |
| 26 | $C_2H_5$ | $C_2H_5$ | H, H, H | 1 | 0,1 | — | $NO_2$ | 604 | 140 | v. good | blue | colour-less | 1 |
| 27 | $CH_3$ | $C_2H_5$ | H, H, H | 1 | 0,1 | — | $NO_2$ | 603 | 208 | v. good | blue | colour-less | 1 |
| 28 | $C_2H_5$ | $CH_3$ | H, H, H | 1 | 0,1 | — | $NO_2$ | 603 | 146 | v. good | blue | colour-less | 1 |
| 29 | $CH_3$ | $CH_3$ | H, H, H | 1 | 0,1 | — | $NO_2$ | 604 | 228 | v. good | blue | colour-less | 1 |
| 30 | $C_2H_5$ | $C_6H_5CONH$ | H, H, H | 1 | 1,0 | S | $NO_2$ | 496 | 238 | | | | 3 |
| 31 | $C_2H_5$ | $C_6H_5CONH$ | H, H, H | 1 | 1,0 | O | $NO_2$ | 462 | 233 | | | | 3 |
| 32 | $C_2H_5$ | $C_6H_5CONH$ | H, H, H | 1 | 1,0 | —CH=CH— | $NO_2$ | 504 | 220 d | | | | 3 |
| 33 | $C_2H_5$ | $C_6H_5CONH$ | H, H, H | 1 | 0,1 | — | $NO_2$ | 534 | | | | | 3 |
| 34 | $C_2H_5$ | $COOC_2H_5$ | H, H, H | 2 | 1,0 | S | $NO_2$ | 574 | 125 | fair | blue | lighter | Ex.5 |
| 35 | $C_2H_5$ | $C_6H_5CO$— | H, H, H | 2 | 1,0 | S | $NO_2$ | 590 | 203 | | | | 4 |

What is claimed is:

1. A light sensitive composition comprising an intimate mixture of a substantially light-insensitive silver compound which upon reduction gives a visible change and sufficient amount of a silver halide to catalyse said reduction to give a visible change in those areas where the silver halide has been exposed to light when the intimate mixture is heated in the presence of a reducing agent, the intimate mixture including as an acutance dye a compound of the general formula:

wherein:

n is 1 when k is 0 or k is 1 when n is 0, m is 0, 1 or 2,

Y is a member selected from the group consisting of —CN and $NO_2$, $R^1$ represents an alkyl group containing 1 to 12 carbon atoms, $R^2$ is a member selected from the group consisting of a phenyl group, a substituted phenyl group of molecular weight less than 350, $—COOR^1$ wherein $R^1$ is an alkyl group of 1 to 12 carbon atoms, $C_6H_5CO$— or $R^6NHCO$— wherein $R^6$ is a member of the group consisting of a hydrogen atom, alkyl, aryl or aralkyl group, and when m is 1 or 2, $R^2$ may additionally represent a member of the group consisting of a hydrogen atom and an alkyl group having 1 to 4 carbon atoms, $R^3$, $R^4$ and $R^5$ are cyanine dye compatible substituents, D represents a member of the group consisting of (CH=CH), O, S, Se, $>C(CH_3)_2$ or $>NR^7$, wherein $R^7$ is selected from the group consisting of an alkyl group containing 1 to 4 carbon atoms and $CH_3COO$—, with the proviso that:

when k=0, n=1, m=0 and Y is $NO_2$ $R^2$ is not a substituted phenyl group of the formula:

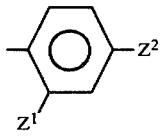

wherein one of $Z^1$ and $Z^2$ is $NO^2$ and the other is a member of the group consisting of a halogen atom, —$NO_2$, —CN and a perfluoroalkyl group containing 1 to 4 carbon atoms.

2. A light sensitive composition according to claim 1 wherein k=0 and n=1.

3. A light sensitive composition as claimed in claim 2 wherein $R^2$ is a member of the group consisting of $COOC_2H_5$, $C_6H_5$, an alkyl group of 1 to 4 carbon atoms and hydrogen and Y is $NO_2$.

4. The composition of claim 2 in which said light insensitive silver compound is a silver salt of an organic acid.

5. A light sensitive composition as claimed in claim 1 wherein $R^2$ is a member of the group consisting of $COOC_2H_5$, $C_6H_5$, an alkyl group of 1 to 4 carbon atoms and hydrogen and Y is $NO_2$.

6. The composition of claim 5 in which said light sensitive silver compound is a silver salt of an organic acid.

7. A light sensitive composition as claimed in claim 1 wherein m=1, k=1, n=0, D is a member of the group consisting of oxygen and sulphur, $R^2$ is a member of the group consisting of $COOR^1$, $C_6H_5$, a substituted phenyl group of molecular weight less than 350, an alkyl group of 1 to 4 carbon atoms and hydrogen and Y is $NO_2$.

8. The composition of claim 7 in which said light insensitive silver compound is a silver salt of an organic acid.

9. A light sensitive composition as claimed in claim 1 wherein $R^1$ represents an alkyl group of 1 to 4 carbon atoms.

10. A light sensitive composition as claimed in claim 9 wherein $R^1$ is selected from methyl and ethyl.

11. A light sensitive composition as claimed in claim 1 wherein $R^3$, $R^4$ and $R^5$ each represent a hydrogen atom.

12. A light sensitive composition as claimed in claim 1 wherein said dye is used in an amount of from $5\times10^{-4}$ to 0.1 mole per kilogram of total dry solids in the composition.

13. A light sensitive composition as claimed in claim 12 wherein said dye is used in an amount of $2\times10^{-3}$ to $3\times10^{-2}$ per kilogram of total dry solids in the composition.

14. The composition of claim 12 in which said light insensitive silver compound is a silver salt of an organic acid.

15. The composition of claim 1 in which said light sensitive silver compound is a silver salt of an organic acid.

* * * * *